US005078669A

United States Patent [19]

Dietrich et al.

[11] Patent Number: 5,078,669

[45] Date of Patent: Jan. 7, 1992

[54] TRANSFER APPARATUS FOR FLAT ARTICLES

[75] Inventors: Walter Dietrich, Weinstadt; Iris Hetzel, Rommelshausen; Eberhard Krieger, Weinstadt, all of Fed. Rep. of Germany

[73] Assignee: Robert Bosch GmbH, Stuttgart, Fed. Rep. of Germany

[21] Appl. No.: 622,580

[22] Filed: Dec. 5, 1990

[30] Foreign Application Priority Data

Feb. 3, 1990 [DE] Fed. Rep. of Germany ..... 4003154

[51] Int. Cl.[5] ..... B65M 3/08; B31B 1/80

[52] U.S. Cl. ..... 493/315; 493/123; 271/91

[58] Field of Search ..... 493/313, 315, 316, 317, 493/123, 124, 125; 248/205.5, 206.2, 206.3, 206.4, 362, 363; 271/90, 91, 96; 294/64.1, 65

[56] References Cited

U.S. PATENT DOCUMENTS 4,113,117 9/1978 Douglas et al. ..... 271/12 X
4,537,587 8/1985 Langen ..... 493/315
4,579,551 4/1986 Ulrich et al. ..... 493/316 X
4,674,998 6/1987 Benedicenti ..... 493/124 X
4,793,657 12/1988 Mense ..... 271/91 X
4,804,173 2/1989 Pol et al. ..... 271/91 X

FOREIGN PATENT DOCUMENTS 3730063 10/1988 Fed. Rep. of Germany .

*Primary Examiner*—William E. Terrell
*Assistant Examiner*—John A. Marlott
*Attorney, Agent, or Firm*—Edwin E. Greigg; Ronald E. Greigg

[57] ABSTRACT

A transfer apparatus for folding boxes including suction heads disposed on a carrier and for holding the folding boxes by negative pressure. To enable adjusting the suction heads to a format of folding boxes to be manipulated, the suction heads have a plurality of cup-shaped suction devices, individual ones of which can be adjusted out of the working position into a position of repose and which can be blocked off from the negative pressure. To this end, the adjustable suction devices are mounted on necks displaceable in carriers, and the necks can be arrested in two positions.

3 Claims, 2 Drawing Sheets

TRANSFER APPARATUS FOR FLAT ARTICLES

BACKGROUND OF THE INVENTION

The invention is based on an apparatus for transferring flat articles, in particular folding boxes as set forth hereinafter.

Transfer apparatuses of this kind are disposed between a magazine for folding boxes and a conveyor apparatus of a cardboard box making machine, and they serve to take one folding box at a time out of the magazine, open it, and transfer it to a conveyor bucket of the conveyor apparatus. The suction devices of a suction head are disposed on a suction head carrier in such a way that they engage a wall of the folding box in a distributive manner so that the box has adequate rigidity when pulled open or pushed open. Accordingly, the disposition of the suction devices of a suction head s made in accordance with the format of the folding boxes to be handled, in particular with their width and length. Until now, this kind of format adaptation was done by replacing individual suction devices on the carrier and closing the connection bores with plugs. To make a faster change of format possible, it is also known to embody the complete suction heads as format-specific parts and to change them when a change to a new format was made.

OBJECT AND SUMMARY OF THE INVENTION

The transfer apparatus according to the invention has an advantage over the prior art in that upon a change of format, only individual suction devices need either be activated, by displacing them into the working plane, or put out of operation, by shifting them into a position of repose, which can be done in a very short time. Shifting suction devices into a position of repose, in which the suction devices are spatially recessed relative to their working position, also has an advantage that the switched-off suction devices do not come into contact with an of the folding boxes or with any parts of the apparatus, either.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
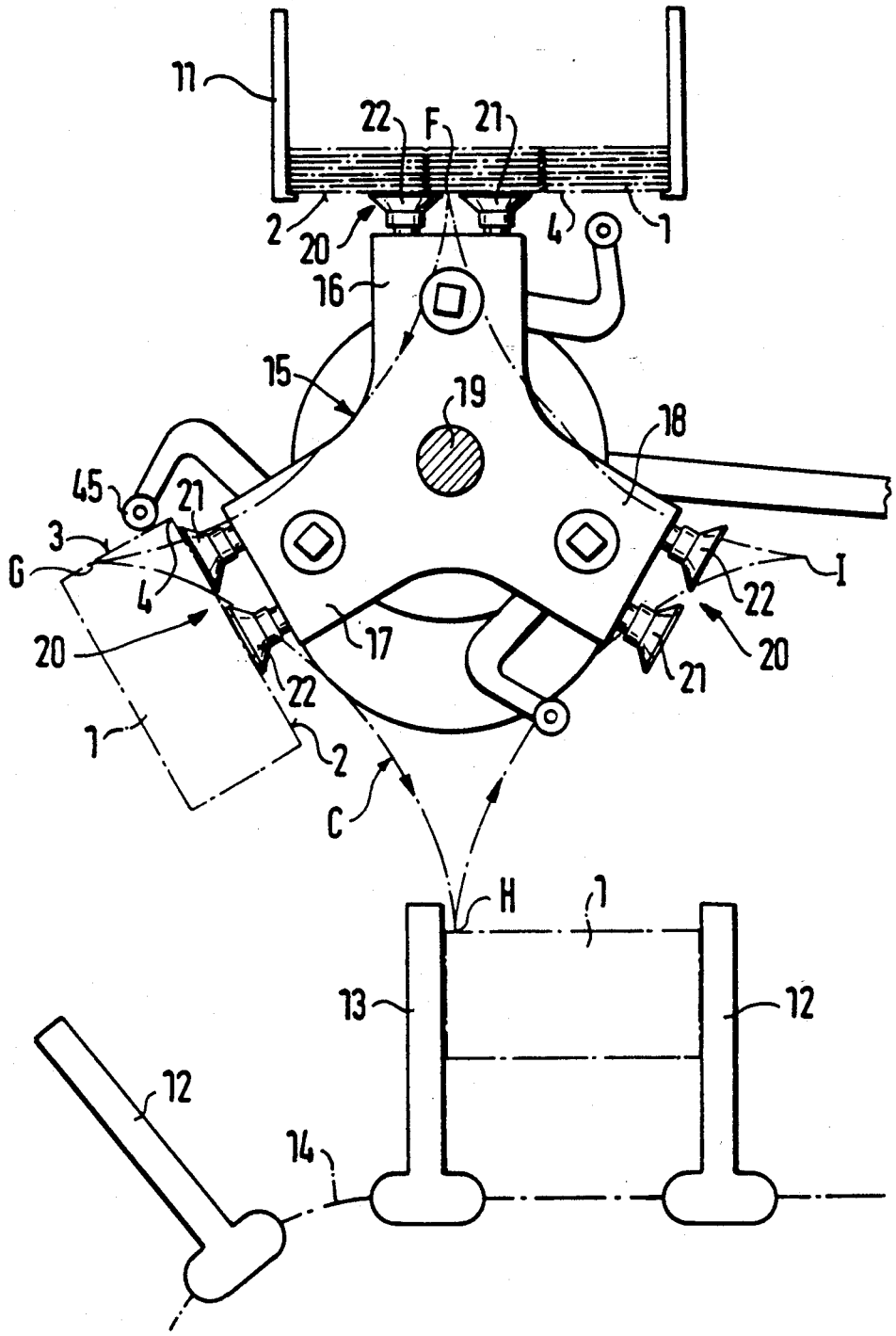
FIG. 1 shows a folding box transfer apparatus in a front view.

The folding box transfer apparatus is disposed between a magazine 11 for folding boxes 1, lying flat, and a conveyor apparatus 14, equipped with pairs of drivers 12, 13, of a cardboard box making machine. It has a three-armed star-type rack 15, with one suction head 20 on the end of each arm 16, 17, 18. The star rack 15 revolves on a circular path and is also rotated about its axis 19, so that its arms 16, 17, 18 move along a cycloid path. For a center point in the engagement plane of a suction head 20, the cycloid path C, which has four reversal points F, G, H, I, is shown in dot-dashed lines.

In the exemplary embodiment shown, each suction head 20 has two cup-shaped suction devices 21, 22, which are open toward the outside and the suction plane of which is adjustable in a common engagement plane. In the common engagement plane, the suction cups 21, 22 of each suction head 20 assume a working position (FIG. 1). One of the two suction cups 21, 22 of each suction head 20, specifically the trailing cup 21 (that is, the one behind, in terms of the direction of movement of the star rack 15), is secured on a threaded neck 23, which is seated in a radial bore 24 of each arm 16, 17, 18, forming a carrier, of the star rack 15 and is secured with a check nut 25. The other suction cup 22 of each suction head is seated on a neck 27, which is displaceable in a section radial bore 28, parallel to the first, of the arm 16, 17, 18. The radial bore 24 intersects a transverse bore 29 in each arm 16, 17, 18, and the radial bore 28 penetrates the transverse bore. The transverse bore 29 communicates with a source of negative pressure via a connection neck 30, a line 31, and a control valve (not shown).

Figure 2:
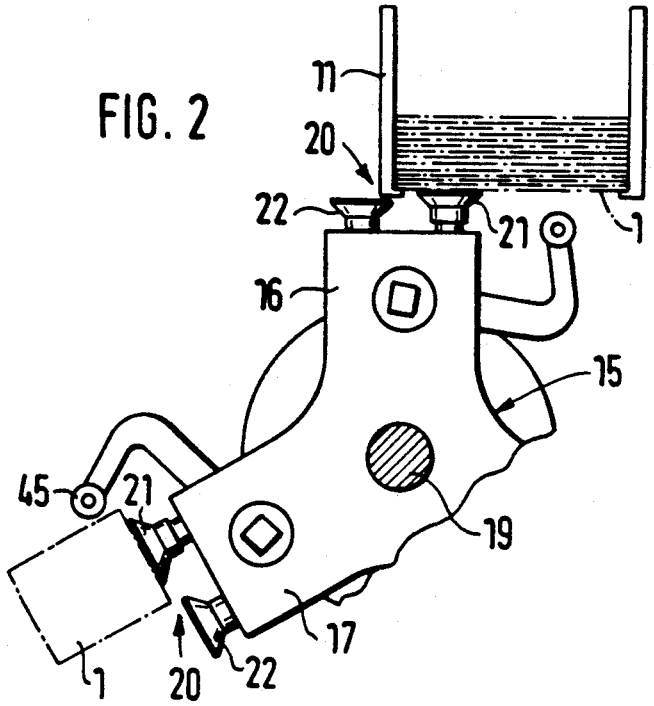
FIG. 2 shows parts of the transfer apparatus of FIG. 1 in a front view, in a different arrangement.
Figure 3:
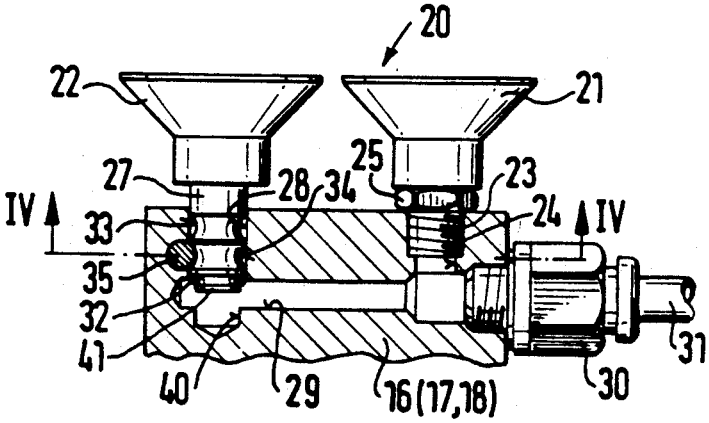
FIG. 3 shows the suction head of the transfer apparatus in longitudinal section.
Figure 4:
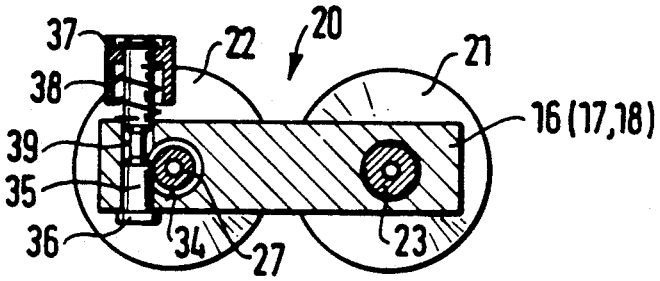
FIG. 4 shows a suction head in cross section, taken along the plane IV—IV of FIG. 3.

With the neck 27, the second suction cup 22 of each suction head 20 is adjustable with respect to the first suction cup 21, or to its working plane formed by the opening, specifically being adjustable into two positions, a working position in which its opening is located in the same engagement or working plane as that of the first suction cup 21, and a position of repose in which its opening is recessed relative to the working plane (see FIG. 2). To this end, the displaceable neck 27 has two axially offset annular grooves 33, 34 in its circumference; a locking pin 35 that is displaceable in the arm 16, 17, 18 engages of these grooves. The locking pin 35, transversely penetrating the arm 16, 17, 18, has a stop head 36 on one end and a caplike button 37 on the other, which keeps the pin 35 in the locking position shown, via a compression spring 38. When the button 37 is pressed, a restriction 39 in the pin 35 reaches the region of the groove 33, 34, so that the lock is tripped, and the neck 27 having the suction cup 22 can be axially displaced into a different position in the radial bore 28.

The length of the neck 27 of the second suction cup 22 is selected such that in its working position, in which the opening of the suction cup 22 is in the working plane, its open free end 41 protrudes into the transverse bore 29, so that the suction cup 22 is activated by the negative pressure. Contrarily, in its lower position or position of repose, the free end 41 of the neck 27 protrudes into the part 40 of the radial bore 2 that protrudes past the transverse bore 29, so that its face end, with the opening of the through bore 26, is located in the part 40 of the radial bore 28 and closed off from it, and as a result the suction cup 22 no longer communicates with the negative pressure source. In the vicinity of its free lower end 41, the neck 27 has a sealing ring 32, which in the protruding part 40 of the radial bore 20 assures complete sealing.

For transferring wide folding boxes 1 (FIG. 1), the displaceable suction cup 22 on each arm 16, 17, 18 of the star rack 15 is moved into the radially outer position or working position, in which the opening of the suction cup 22 is located in the same working plane as that of the other, fixed suction cup 21 belonging to the same suction head 20. In this position, both suction cups 21 and 22 are activatable with negative pressure via the control valve. Contrarily, for transferring narrow folding boxes 1 (FIG. 2), the adjustable suction cup 22 is displaced into its position of repose, in which its opening is recessed from the working plane, and in which the action of the negative pressure is disrupted. In this position of repose, orientational problems are also prevented.

In the exemplary embodiment shown and described here, the neck 27 of the suction cup 22 is displaceable and can be locked in two positions with a lock. The neck 27 may also be provided with a thread and adjusted with screws to set its working position and its position of repose in the radial bore.

In the exemplary embodiment shown, the suction heads 20 of the star rack 15 are moved successively to the lower end of the magazine 11; at a wall 2 defined by fold grooves, by negative pressure, the suction heads engage a flat folding box 1 that has been made ready and they pull these folding boxes downward out of the magazine 11. Along the further course of the transfer path of the folding boxes 1, pressure prongs 45 pivot toward a wall 3, which is connected to the firmly held wall 2 by a fold line 4, and they press the firmly held folding box 1 open, before transferring it to a position between a pair of drivers 12, 13 of the conveyor apparatus 14.

It should also be noted that in the exemplary embodiment of the transfer apparatus shown, only a single star rack 15, each with one pair of suction cups 21, 22 on each arm 16, 17, 18 is shown. For engaging and holding very wide folding boxes, more than two suction cups may be disposed side by side, instead of only two, all of them being adjustable into a working position and a position of repose. For transferring long folding boxes, the transfer apparatus may also be equipped with two or more axially coinciding star racks, so that the folding boxes are held rigidly over their entire length. Naturally, the suction cups of the additional star racks are embodied and arranged as described above.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A transfer apparatus for flat articles, in the form of folded boxes, which comprises at least one suction head (20) for firmly holding an article on one side by means of negative pressure, said at least one suction head has a plurality of suction devices (21, 22) oriented in a common working plane on at least one carrier (16, 17, 18), which suction devices are arranged to communicate with a source of negative pressure, at least one of the suction devices (21, 22) includes a neck (27) with at least two axially offset annular grooves (33 and 34) in its circumference for axial adjustment between a working position in said common working planes when connected to a conduit (29) carrying negative pressure and a position of repose in a non-working plane in which said at least one carrier is disconnected from said conduit carrying negative pressure, locking means juxtaposed to said at least one suction device for engagement with one of said two axially offset annular grooves for positioning said at least one suction device in either a working position in said common working plane or a position of repose in a non-working plane.

2. A transfer apparatus as set forth in claim 1 in which said locking means is spring loaded for movement into a position of nonengagement with one of said two axially offset annular grooves.

3. A transfer apparatus as set forth in claim 2 in which said spring loaded locking means includes a restriction (39) which permits axial movement of said at least one suction device to a working position or to a position of repose.

* * * * *